US006488242B1

(12) United States Patent
Barriere

(10) Patent No.: US 6,488,242 B1
(45) Date of Patent: Dec. 3, 2002

(54) BAG MOUTH HOLDER FOR BOTTLE AND CAN BAGGER AND METHOD

(76) Inventor: Francis A. Barriere, 623 Pleasant St., Rochdale, MA (US) 01542

( * ) Notice: Subject to any disclaimer, the term of this patent is extended or adjusted under 35 U.S.C. 154(b) by 0 days.

(21) Appl. No.: 10/052,374

(22) Filed: Jan. 23, 2002

Related U.S. Application Data

(60) Provisional application No. 60/263,513, filed on Jan. 24, 2001.

(51) Int. Cl.[7] ..... B65B 67/04; A47F 5/00; A47F 7/00

(52) U.S. Cl. ..... 248/99; 248/100; 248/314; 248/315; 248/907

(58) Field of Search ..... 248/99, 101, 314, 248/315, 907

(56) References Cited

U.S. PATENT DOCUMENTS

| | | | | | |
|---|---|---|---|---|---|
| 972,810 | A | * | 8/1910 | Kandlbinder | 248/101 |
| 988,097 | A | | 3/1911 | Heyd | |
| 1,121,388 | A | | 12/1914 | Milks | |
| 1,392,716 | A | * | 10/1921 | Spraggins | 248/101 |
| 1,548,968 | A | * | 8/1925 | Donovan | 248/101 |
| 2,462,973 | A | | 3/1949 | Kelrick | |
| 3,468,505 | A | | 9/1969 | Reilly | |
| 3,614,041 | A | | 10/1971 | Koger | |
| 3,893,649 | A | | 7/1975 | Cornell et al. | |
| 4,069,994 | A | * | 1/1978 | Wharmby | 248/101 |
| 4,287,701 | A | | 9/1981 | Washington | |
| 4,312,489 | A | | 1/1982 | Paetzold | |
| 4,738,478 | A | | 4/1988 | Bean, Jr. | |
| 4,951,903 | A | * | 8/1990 | Frey | 248/99 |
| 5,020,751 | A | | 6/1991 | Larkin | |
| 5,456,431 | A | * | 10/1995 | Ilnisky | 248/98 |
| 5,570,862 | A | | 11/1996 | Nugent | |
| 5,641,138 | A | * | 6/1997 | Cronk | 248/99 |
| 5,836,553 | A | | 11/1998 | Bergaila | |
| 5,950,251 | A | * | 9/1999 | Cost | 4/483 |
| 6,086,022 | A | * | 7/2000 | Dalton | 248/99 |
| 6,202,709 | B1 | * | 3/2001 | Wymer | 141/10 |

* cited by examiner

*Primary Examiner*—Leslie A. Braun
*Assistant Examiner*—Amy J. Sterling
(74) *Attorney, Agent, or Firm*—James Creighton Wray; Meera P. Narasimhan

(57) ABSTRACT

The device method of holding a mouth of a bag. The mouth of a bag is drawn through the inside of a hoop, and then is folded around the outside of the hoop. The open edge of the mouth of the bag is positioned below the outside of the hoop. An elastic O-ring is then stretched around the portion of the bag end which overlies the hoop. The O-ring is positioned on the hoop beneath a shelf and is stretched around a lug on a sloping support to hold the bag securely. Triangular openings allow finger insertion to remove the band.

20 Claims, 2 Drawing Sheets

BAG MOUTH HOLDER FOR BOTTLE AND CAN BAGGER AND METHOD

This application claims the benefit of U.S. Provisional Application No. 60/263,513, filed Jan. 24, 2001.

SUMMARY OF THE INVENTION

The bag mouth holder of the present invention has a five to eight inch hoop mounted on a sloping holder which is attached to a vertical wall plate. The hoop has a wide upper portion and a narrow lower portion with an intermediate step. The angled support has a notch or a vertically extending lug. The mouth of the bag is inserted upward through the hoop and turned outward and downward around the outside of the hoop. A stretchable band is inserted over the bag end and under the step on the hoop and over the lug or notch in the support. The step prevents the band from sliding upward on the hoop, and the notch or lug holds the band upward so that it does not slide downward off the hoop. The notch or lug provides two generally triangular areas in which the band is spaced outward from the support and hoop so that fingers may be inserted in the band to lift the band off the notch or lug and hoop to remove and replace the bag.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
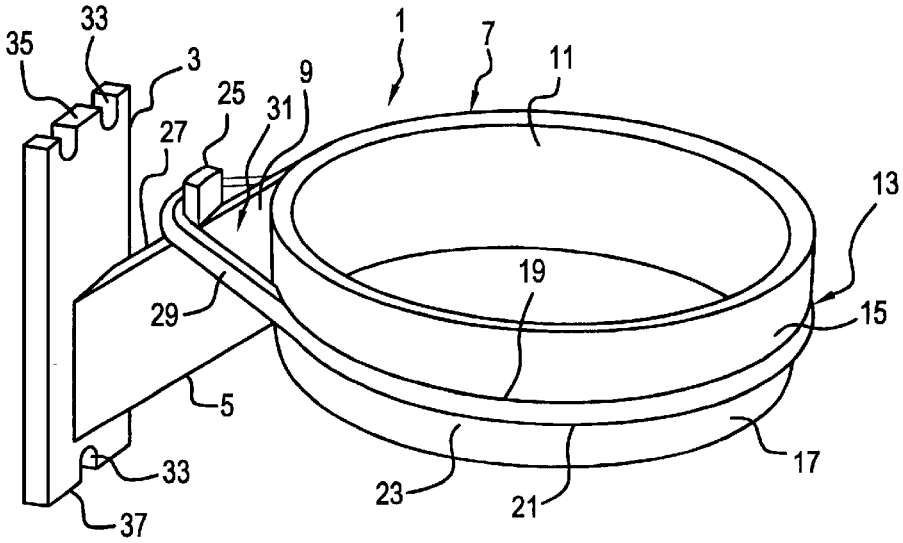
FIG. 1 is a perspective view of a bag mouth holder, including a band.
Figure 2:
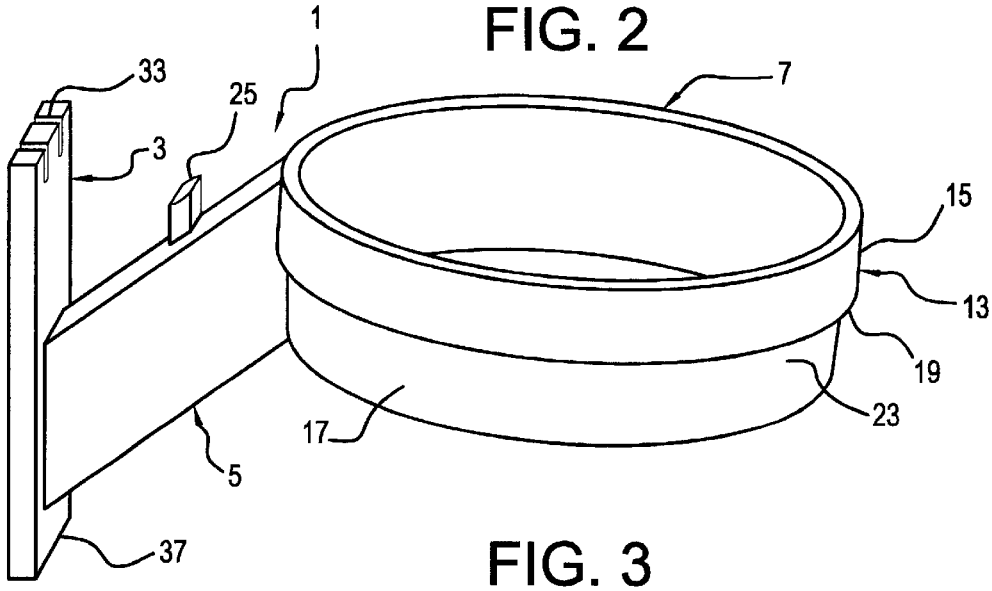
FIG. 2 is a perspective view of the bag mouth holder from which the band has been removed.

Referring to FIG. 1, a bag mouth holder is generally indicated by the numeral 1. The bag mouth holder includes a wall mount 3, an upward sloping support 5 extending upward out outward from the wall mount 3, and a hoop 7 connected to an outer end 9 of the sloping support 5.

The hoop 7 has a smooth inner surface 11. The outer surface 13 of the hoop has an upper portion 15 and a lower portion 17, which is inset from the upper portion 15. A shelf 19 separates the upper portion 15 and the lower portion 17. A band 21, which is preferably an elastomeric band, stretches around the upper portion 23 of the lower wall beneath the shelf 19. The elastomeric band is preferably an O-ring. A lug 25 on the top 27 of the upward sloping support 5 holds one portion 29 of the band 21 in a stretched condition, which forces the band into contact with the upper portion 23 of the lower section 17, and into contact with shelf 19 between the upper portion 15 and the lower portion 17 of the outer surface 13.

Stretching the band leaves triangular finger openings 31 on either side of the sloping support 5 between the inner portions 29 of the band and the side walls of the support 5. The triangular areas 31 allow fingers to grasp the free parts 29 of the band 21 to lift the band over the lug 25 and to continue lifting the band over the upper portion 15 of the hoop to make the hoop ready to receive a bag or to remove and install a bag from the hoop.

Notches 33 are provided in the upper and lower edges 35 and 37 of the vertical wall plate 3 to attach the mount with screws.

Figure 3:
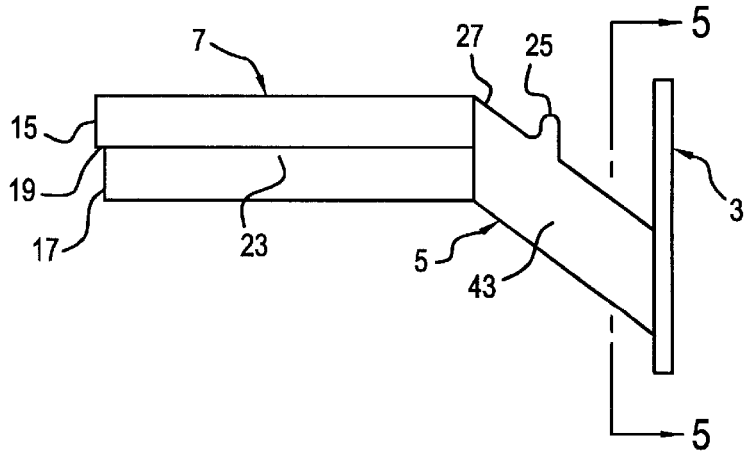
FIG. 3 is a side elevation of a preferred bag mouth holder.
Figure 4:
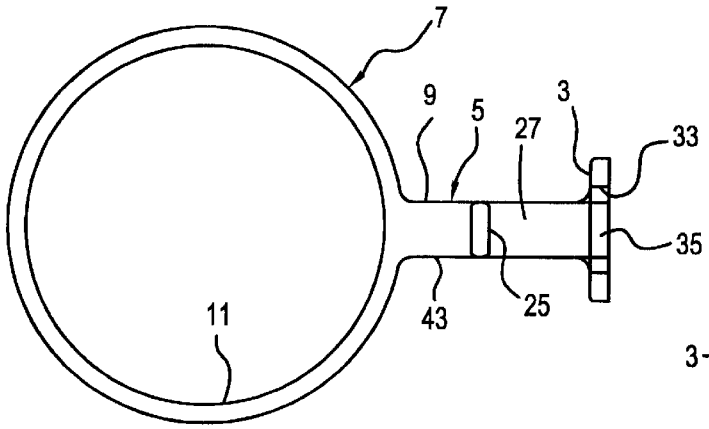
FIG. 4 is a plan view of the bag mouth holder shown in FIG. 3.
Figure 5:
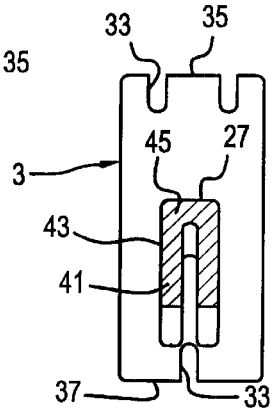
FIG. 5 is an enlarged cross-sectional view taken along section line A—A in FIG. 3.

As shown in FIGS. 3, 4 and 5, the hoop portion 7 has a relatively thin planform. The upward sloping support 5 has a wide body which is formed in a U-shape shape 41, as shown in FIG. 5.

The upper surface 27 is substantially flat, and the elongated side walls 43 are substantially flat and have the same thickness as the top portion 45. The lug 25 extends across the top 27 of the sloping support 5 from side wall to side wall 43. In a preferred embodiment, the lug 25 is curved concentrically with the hoop 7. The concentric curvature allows stretching of the elastomeric O-ring without stressing the O-ring unduly, and makes it easy to remove and apply the O-ring with respect to the lug 25.

The entire bag mount 1 is made of one piece in a preferred embodiment. Alternatively, the three sections 3, 5 and 7 may slide and snapfit together for assembly before use.

Figure 6:
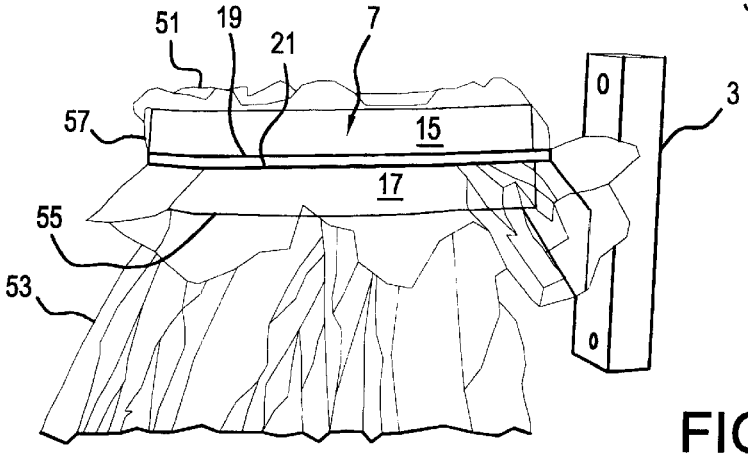
FIG. 6 is a detail of the bag mouth holder on which a bag mouth has been installed.

As shown in FIG. 6, the mouth 51 of a bag 53 is drawn through the inside of the hoop 7, and then is folded around the outside of the hoop. The open edge 55 of the mouth of the bag is positioned below the outside of the hoop. The elastic O-ring 21 is then stretched around the portion 57 of the bag end which overlies the hoop 7. The O-ring 21 is positioned in the lower portion 17 of the hoop beneath the shelf 19 and is stretched around lug 25 to hold the bag securely on the mount 1.

Figure 7:
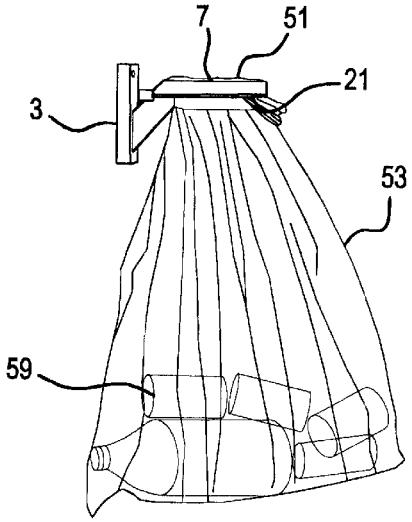
FIG. 7 is a perspective view of a bag mouth holder holding a bag in which cans have been inserted through the open mouth on the holder.

As shown in FIG. 7, the bag 53 holds cans 59 or bottles which are inserted through the mouth of the bag 51 as it is held open by the hoop 7, and as it is held in position by the elastomeric O-ring 21.

The differences in size between upper and lower outer surfaces of the hoop is preferably continued entirely around the hoop. Alternatively, the differences in size between upper and lower surfaces may occur at spaced intervals along the hoop, and the shelf may have spaced portions which effectively hold the elastomeric O-ring in position. Preferably the intersection of the lug 25 and the upper surface 27 of the sloping support 5 is aligned with the shelf 19, or is slightly above the shelf 19, to prevent the elastomeric O-ring from riding down over the lower outer surface 17 of the hoop 7.

While the invention has been described with reference to specific embodiments, modifications and variations of the invention may be constructed without departing from the scope of the invention, which is defined in the following claims.

I claim:

1. A bag mouth holder apparatus, comprising a hoop mounted on a sloping support for attaching to a vertical wall plate, the hoop having a wide upper portion and a narrow lower portion with an intermediate step, the sloping support having a vertically extending lug, a mouth of a bag being inserted upward through the hoop and turned outward and downward, forming a bag end around the outside of the hoop, a stretchable band inserted over the bag end and under the step on the hoop and over the lug or notch on the support, the step preventing the band from sliding upward on the hoop, and the lug holding the band upward so that the band does not slide downward off the hoop, the lug providing two generally triangular areas in which the band is spaced outward from the support and hoop so that fingers may be inserted in the triangular areas to lift the band off the lug and hoop to remove and replace a bag.

2. The apparatus of claim 1, further including a wall mount on an end of the support remote from the hoop.

3. The apparatus of claim 2, wherein the support is an upward sloping support extending upward out outward from the wall mount, and wherein the hoop is connected to an outer end of the sloping support.

4. The apparatus of claim 1, wherein the hoop has a smooth inner surface.

5. The apparatus of claim 1, wherein the band is an elastomeric band which stretches around an upper portion of the lower wall beneath the step.

6. The apparatus of claim 5, wherein the elastomeric band is an O-ring.

7. The apparatus of claim 1, wherein the hoop has a relatively thin planform.

8. The apparatus of claim 7, wherein the upward support has a wide body.

9. The apparatus of claim 1, wherein the sloping support is formed with a U-shape cross-section.

10. A bag mouth holder apparatus, comprising a wall mount, an upward sloping support extending upward and outward from the wall mount, a hoop connected to an outer end of the sloping support, the hoop having a smooth inner surface, an outer surface of the hoop having an upper portion and a lower portion, which is inset from the upper portion, a shelf separating the upper portion and the lower portion, an elastomeric band stretched around the lower portion beneath the shelf, the elastomeric band comprising an O-ring, a lug on a top of the upward sloping support holding one portion of the band in a stretched condition, which forces the band into contact with the lower portion and into contact with shelf between the upper portion and the lower portion of the outer surface.

11. The apparatus of claim 10, wherein stretching the band leaves triangular finger openings on either side of the sloping support between the band and side walls of the sloping support.

12. The apparatus of claim 11, wherein the triangular areas allow fingers to grasp free parts of the band to lift the band over the lug and to continue lifting the band over the upper portion of the hoop, making the hoop ready to receive a bag or to remove a bag and install a bag on the hoop.

13. The apparatus of claim 10, wherein notches are provided in upper and lower edges of the vertical wall plate for attaching the mount with screws.

14. The apparatus of claim 11, wherein the hoop has a relatively thin planform.

15. The apparatus of claim 11, wherein the upward sloping support has a wide body which is formed U-shape.

16. The apparatus of claim 15, wherein the sloping support has an upper surface which is substantially flat, and elongated side walls which are substantially flat and a uniform thickness with the upper surface.

17. The apparatus of claim 16, wherein the lug extends across the upper surface of the sloping support between the side walls.

18. The apparatus of claim 17, wherein the lug is curved concentrically with the hoop and the concentric curvature allows stretching of the elastomeric O-ring without stressing the O-ring unduly.

19. A method of holding a mouth of a bag, comprising inserting the mouth of the bag upward through the hoop and turning the mouth outward and downward around the outside of the hoop, stretching a band over the bag end and under a step on the hoop and over a lug on a support, the step preventing the band from sliding upward on the hoop, and the lug holding the band upward so that it does not slide downward off the hoop, the lug providing two generally triangular areas in which the band is spaced outward from the support and hoop, inserting fingers in the triangular areas, lifting the band off the notch or lug and hoop, and removing and replacing the bag.

20. The method of claim 19, wherein the mouth of a bag is drawn through the inside of the hoop, and then is folded around the outside of the hoop, an open edge of the mouth of the bag being positioned below the outside of the hoop, wherein the band is an elastic O-ring which is then stretched around a portion of the bag end which overlies the hoop, and wherein the O-ring is positioned in the lower portion of the hoop beneath a shelf and is stretched around lug to hold the bag securely, and wherein an intersection of the lug and the upper surface of a sloping support is aligned with the shelf, or is slightly above the shelf, for preventing the elastomeric O-ring from-riding down over a lower outer surface of the hoop.

* * * * *